US007281276B2

(12) United States Patent
Vierkant, III et al.

(10) Patent No.: US 7,281,276 B2
(45) **Date of Patent: *Oct. 16, 2007**

(54) RELEASABLE TOILET SEAT ASSEMBLY

(75) Inventors: Erich C. Vierkant, III, Sheboygan, WI (US); Daniel N. Halloran, Saukeville, WI (US); Brian D. Cowell, Fond du Lac, WI (US)

(73) Assignee: Kohler Co., Kohler, WI (US)

( * ) Notice: Subject to any disclaimer, the term of this patent is extended or adjusted under 35 U.S.C. 154(b) by 35 days.

This patent is subject to a terminal disclaimer.

(21) Appl. No.: 10/966,271

(22) Filed: Oct. 15, 2004

(65) Prior Publication Data

US 2005/0217009 A1 Oct. 6, 2005

Related U.S. Application Data

(63) Continuation-in-part of application No. 10/816,359, filed on Apr. 1, 2004.

(51) Int. Cl.
*A47K 13/12* (2006.01)

(52) U.S. Cl. ..... 4/240; 4/236

(58) Field of Classification Search ..... 4/236, 4/240; 16/252, 254

See application file for complete search history.

(56) References Cited

U.S. PATENT DOCUMENTS

| | | | | | |
|---|---|---|---|---|---|
| 1,701,115 | A | * | 2/1929 | McKinney, Jr. | 4/235 |
| 2,221,991 | A | * | 11/1940 | Myers et al. | 4/239 |
| 2,333,732 | A | * | 11/1943 | Morris | 4/240 |
| 4,080,671 | A | | 3/1978 | Stähli | |
| 4,133,061 | A | | 1/1979 | Hurd | |
| 4,159,548 | A | | 7/1979 | Hewson | |
| 4,173,802 | A | | 11/1979 | Wikstrom | |
| 4,309,780 | A | | 1/1982 | Fantetti | |
| 4,319,365 | A | | 3/1982 | Bemis et al. | |
| 4,326,307 | A | | 4/1982 | Baillie et al. | |
| 4,589,148 | A | * | 5/1986 | Cameron | 4/236 |
| 4,832,573 | A | | 5/1989 | Dorski | |
| 4,970,731 | A | | 11/1990 | Fait | |
| 4,974,262 | A | * | 12/1990 | Rosen | 4/236 |
| 4,985,939 | A | | 1/1991 | Otte | |
| 5,175,891 | A | | 1/1993 | Ohshima et al. | |
| 5,341,517 | A | * | 8/1994 | Bly | 4/236 |
| 5,515,552 | A | | 5/1996 | Tolsma | |
| 5,666,672 | A | | 9/1997 | Birsel et al. | |
| 5,749,104 | A | * | 5/1998 | Evans | 4/239 |
| 5,901,383 | A | | 5/1999 | Yanagawa et al. | |

(Continued)

FOREIGN PATENT DOCUMENTS

AU 425 871 B2 7/1972

(Continued)

*Primary Examiner*—Khoa D. Huynh
(74) *Attorney, Agent, or Firm*—Quarles & Brady

(57) ABSTRACT

A mounting assembly is disclosed for mounting a toilet seat and/or cover in a releasable fashion to the rear of a toilet bowl base. The assembly includes a fastener permanently affixed to the toilet base on which is mounted a cross shaped mount. The mount is engaged by deflectable arms extending from a hinge base. The arms flex outward slightly during mounting and dismounting, where mounting and dismounting can be achieved by a horizontal sliding motion. A hinged cap snaps onto the pair of arms to cover the fastener and prevent deflection of the arms and thus separation of the base member from the fastener.

10 Claims, 3 Drawing Sheets

U.S. PATENT DOCUMENTS 5,933,875 A 8/1999 Hulsebus et al.
6,070,295 A 6/2000 Hulsebus
6,089,807 A * 7/2000 Larsson ..... 4/236
6,263,516 B1 * 7/2001 Pedersen et al. ..... 4/236
6,381,762 B1 5/2002 Moser
6,643,851 B1 * 11/2003 Janes ..... 4/236

FOREIGN PATENT DOCUMENTS

GB 2280219 1/1995
GB 2 289 902 A 12/1995
JP 9-84724 3/1997

* cited by examiner

FIG. 1
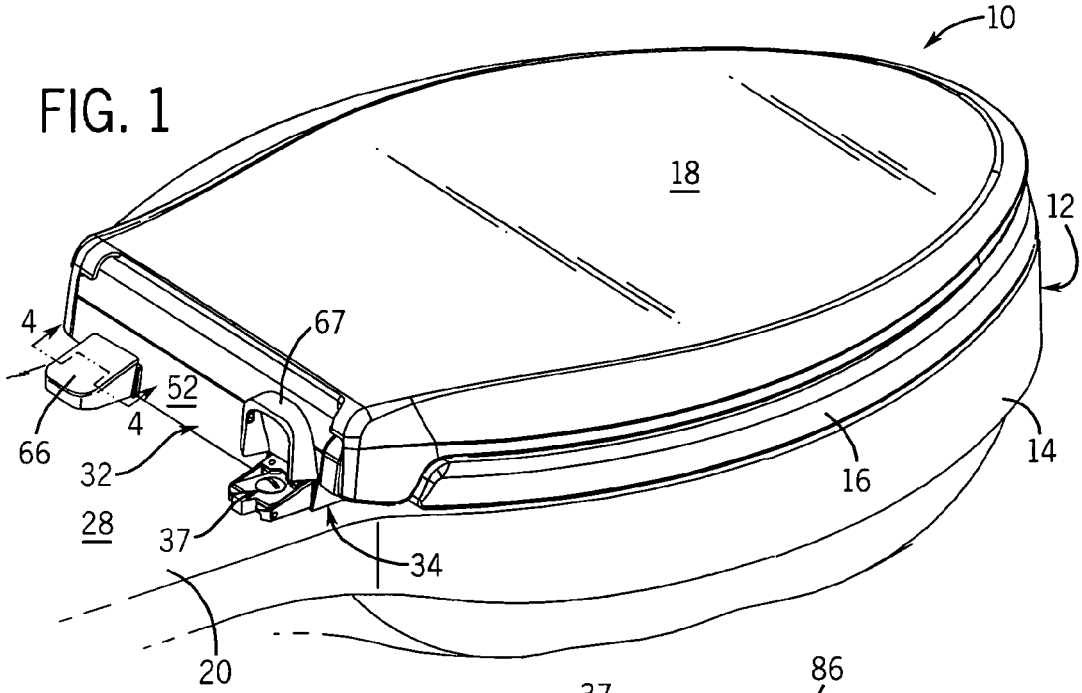
FIG. 2
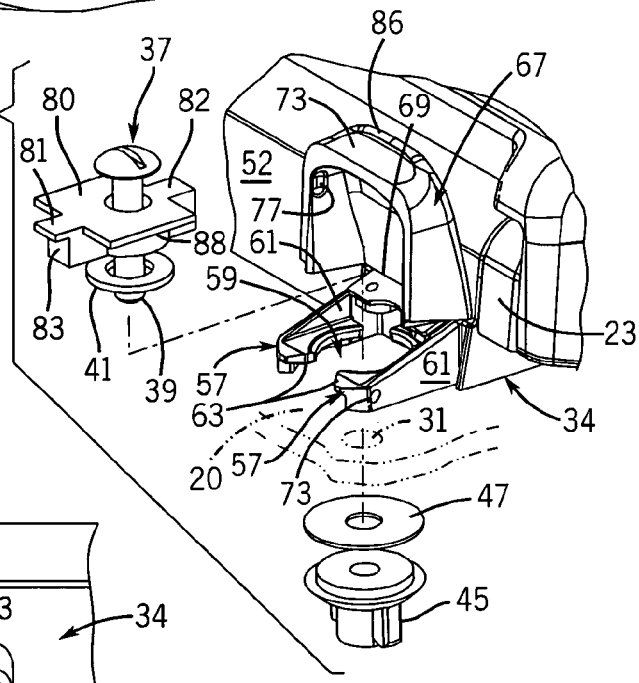
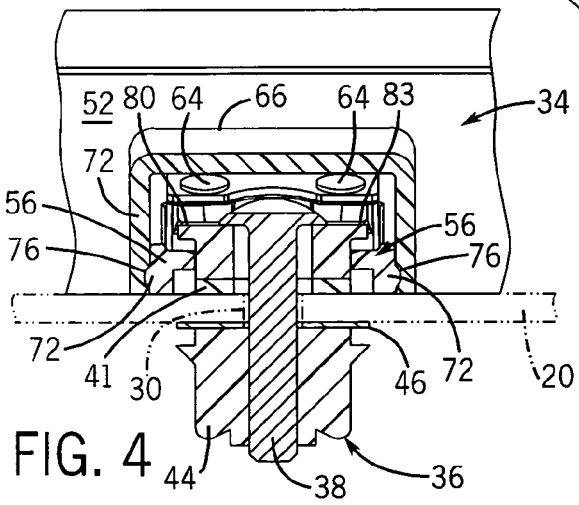
FIG. 4

FIG. 5
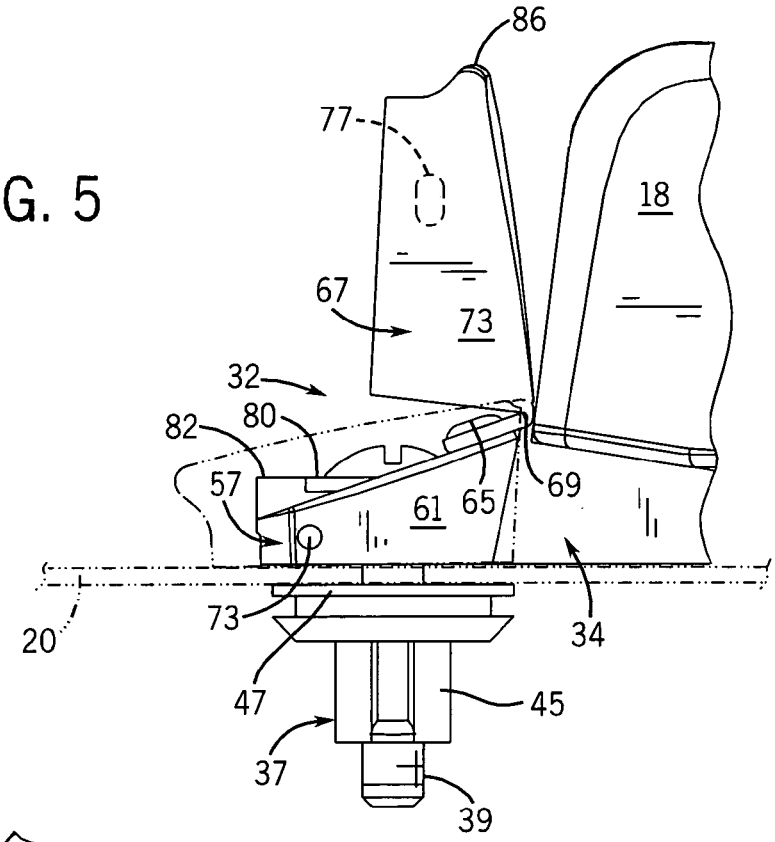
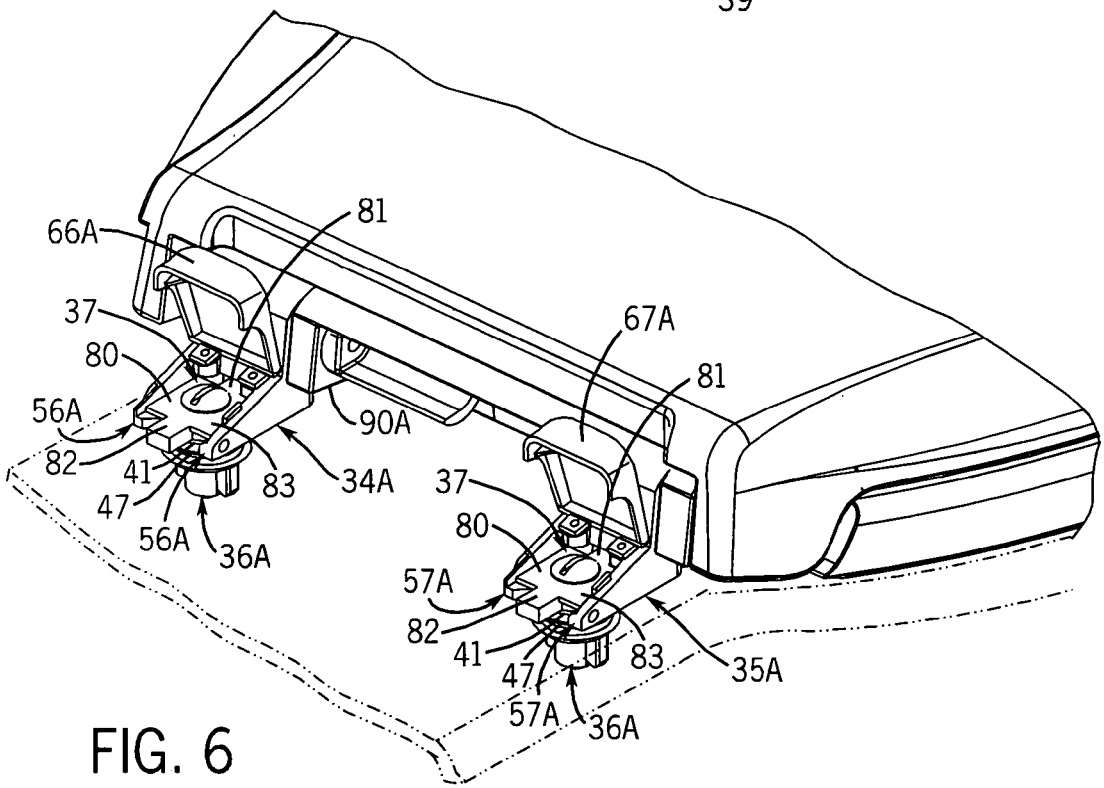
FIG. 6

RELEASABLE TOILET SEAT ASSEMBLY

CROSS-REFERENCE TO RELATED APPLICATION

This is a continuation-in-part of U.S. patent application Ser. No. 10/816,359, filed Apr. 1, 2004.

STATEMENT OF FEDERALLY SPONSORED RESEARCH/DEVELOPMENT

Not applicable.

BACKGROUND OF THE INVENTION

The present invention relates to mounting toilet seats and/or covers to the top of toilet bowls. More particularly, it relates to assemblies that permit most of the assembly parts to be readily removed from the toilet to facilitate cleaning.

Typically, toilet seats and covers are sold pre-assembled together along a hinge assembly. The assembly is then affixed via hinge posts to a rearward extension of the toilet base behind the bowl. In such constructions the posts are typically bolted to the rearward extension using a bolt-like fastener that extends down through the extension. A nut threads onto the fastener from underneath the extension to clamp the assembly to the extension.

These assemblies are intended to be essentially permanently affixed to the toilet base extension, particularly given that assembly and removal requires the application of tooling at the underside of the extension. This can create a problem because the area around such hinge posts (behind and under the cover and seat) can be difficult to clean thoroughly. In this regard, urine and other contaminants can collect around the hinge posts, with the subsequent development of an undesirable appearance or smell, or unsanitary conditions.

As such, there have been a number of attempts to develop toilet seat hinge assemblies where the seat and cover and associated pivot pins can be removed from the toilet relatively easily, and then (after cleaning) be relatively easily reconnected. See e.g. U.S. Pat. Nos. 4,159,548; 4,326,307; 4,965,889; 5,933,875; and 6,070,295, British publication GB 2,280,219; and Japanese publication JP 9-84724.

These systems are easier to clean because they leave only small base posts essentially permanently affixed to the toilet base, while providing readily releasable subassemblies that can removably link up with these posts. However, these prior art systems have a variety of deficiencies.

For example, some rely on a relatively weak connection between the subassembly and base posts such that the subassembly can accidentally be knocked off the posts. Others rely on relatively weak parts which may have a high incidence of breakage over prolonged use. Still others require relatively complex multi-part assemblies, which increase the cost of production and may require some consumer training. Still other assemblies require tools for the disassembly for cleaning purposes. Yet others require a consumer to touch portions of the assembly that may themselves be contaminated.

Hence, it can be seen that a need still exists for an improved toilet seat mounting assembly, particularly one which facilitates removal of the seat and cover for cleaning purposes.

BRIEF SUMMARY OF THE INVENTION

The present invention provides a mounting assembly for connecting a covering element (e.g., a toilet seat, a toilet cover, or a toilet seat/cover combination) to a toilet base. The preferred mounting location is a horizontal upwardly facing surface of a rearward extension of the toilet base behind the bowl.

One aspect of the invention provides an assembly for mounting a cover to a toilet base. The assembly has a fastener extendable through a rear extension of the toilet base, a base member adapted to support the cover in pivotal fashion, the base member having an essentially horizontally extending deflectable extension arm defining in part an opening for receiving the fastener, and a mount disposed about the fastener and having a portion extendable over the extension arm. The base member can be connected to and disconnected from the fastener by deflection of the extension arm so that the base member can be removably attached to the toilet base.

In preferred forms the mount is generally cross-shaped in top view, a forward cross arm thereof has an undercut portion, and the base member has two such extension arms arranged spaced apart on opposed sides of the opening, whereby arcuate portions of the arms can hug arcuate portions of the mount.

In other preferred forms there is also a cap capable of restricting outward deflection of the extension arm when the cap is in a closed position. The cover can be hinged to the base member, such as by being linked to the base member via a living hinge. Preferably, the fastener is a bolt extendable through the opening in the base member and a hole in the rear extension of the toilet base, and there is also a nut positionable on the bolt underneath the rear extension of the toilet base.

The present invention thus provides a quick connect/disconnect assembly for releasably attaching a toilet seat and cover to a toilet base. This assembly preferably has two such fastener assemblies essentially permanently attached to the toilet bowl base rearward extension, at two spaced apart mounting holes. The other assembly components, namely the base member(s) and the toilet seat/cover, can be completely removed from the toilet base to facilitate thorough cleaning.

The connection is a snap together connection. With the fasteners attached to the toilet base and the base member(s) pre-attached to the toilet seat/cover, the base member(s) snap around the fasteners and under the cross mount(s), for example by deflection of one or more of the extension arms, and each cap is then moved to lock the deflectable arms. This secures the connection and conceals the fasteners for a more pleasing appearance. The toilet seat/cover can be removed by lifting the cover(s) and sliding the toilet seat/cover laterally in the back-to-front direction.

The cross shaped mounting structure is particularly advantageous as it is resistant to rotation (e.g. by interfitting with the base) and provides a particularly secure mounting connection. Further, an undercut at a forward end of the front cross arm can optionally interfit with an extension ledge on the base member to provide a more stable assembly.

It will be appreciated that the assembly of the present invention has a number of important advantages. For one thing, it is comprised of few parts and thus can be inexpensively manufactured. Further, its mechanism of operation does not require a consumer to touch an area of the assembly that is likely to be contaminated. Moreover, the connection is solid, thereby precluding accidental undesired dislodging of the assembly. Further, the parts can be formed to present an aesthetically pleasing appearance.

The present invention permits rapid assembly and disassembly of the seat and cover from the top of the toilet base, without special tools or training. These and still other advantages of the present invention will be apparent from the description that follows. The claims should be looked to in order to ascertain the full scope of the invention.

BRIEF DESCRIPTION OF THE DRAWINGS

FIG. 1 is a rear perspective view showing a toilet seat assembly of the present invention mounting a cover and seat combination on a toilet base rear extension;

FIG. 2 is a partial, enlarged, exploded perspective view of a part of the assembly of FIG. 1;

FIG. 4 is a sectional view taken along line 4-4 of FIG. 1;

FIG. 5 is a partial side elevational view showing one cover member pivoted up, with the other cover member shown in phantom in a downward closed position; and FIG. 6 is a rear perspective view of an alternate embodiment.

DETAILED DESCRIPTION OF THE PREFERRED EMBODIMENTS

Figure 3:
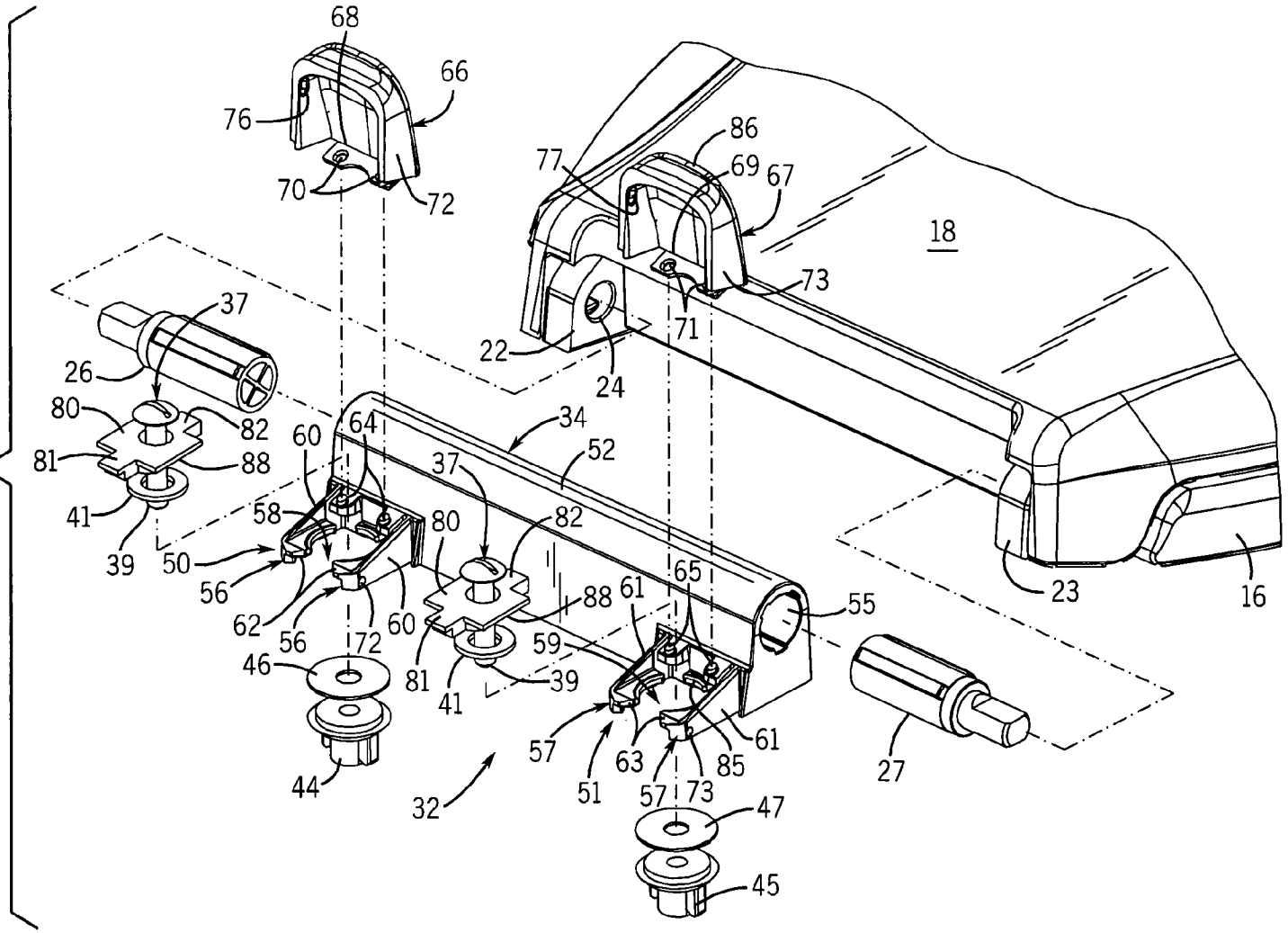
FIG. 3 is an exploded perspective view of the assembly of FIG. 1.

Referring first to FIG. 1, a toilet assembly 10 includes a conventional toilet base generally 12 having a bowl portion 14 and a rear extension 20. A seat 16 and cover 18 are mounted to the extension 20.

As shown in FIG. 3, the seat 16 and cover 18 have ears 22 and 23, each with a horizontal opening 24 (one shown) for receiving the rotatable shafts of hinge pins 26 and 27, respectively, to pivotally mount the seat 16 and cover 18 for pivoting along a horizontal axis parallel to the top plane of the toilet base 12.

Turning next to FIGS. 1, 2 and 4, the rearward extension 20 has a flat top surface 28 with two vertical through holes 30 and 31. The through holes provide the locations for attaching the toilet seat 16 and cover 18 to the toilet base 12 using the mounting assembly of the present invention, generally referred by number 32 shown in FIG. 1.

Referring now mostly to FIGS. 2-5, the mounting assembly 32 includes a base member 34 and a pair of fastener assemblies 36 and 37. The fastener assemblies 36 and 37 include threaded bolts 38 and 39 about which are optionally disposed bottom washers 46 and 47. Mounts 80 and upper rubber gaskets 41 are respectively also positioned around the bolts. If desired, the washers can be omitted entirely, and/or the gaskets can be replaced with an overmolded layer of rubber of the same shape as the gaskets on the bottom of mounts 80.

The bolts 38 and 39 fit into the holes 30 and 31 in the rear extension 20 of the toilet base 12 from the top, with the washers 46 and 47 captured below the extension 20, and the mounts and gaskets 41 captured between the heads of the bolts 38 and 39 and the top surface 28 of the rear extension 20. These components are secured to the toilet base 12 snugly by tightening nuts 44 and 45 onto the respective bolts 38 and 39 from the underside of the rear extension 20.

The base member 34 has two receivers 50 and 51 which cooperate with the respective fastener assemblies 36 and 37 to releasably mount the seat 16 and cover 18 to the toilet base 12. The connection of the seat 16 and cover 18 to the base member is provided by an elongated support 52 with horizontal pockets 55 (one shown) which receive the stationary bodies of respective hinge pins 26 and 27. The receivers 50 and 51 are spaced apart near each end of the base support 52 to align with the fastener assemblies 36 and 37.

Each receiver has a pair of arms 56 and 57 extending horizontally back from the base support 52. Within each pair, the arms 56 and 57 are spaced apart laterally to define vertical openings 58 and 59, which open to the back edge of the receivers. The arms 56 and 57 define vertical side walls 60 and 61, which taper downwardly form the base support 52, as well as inwardly extending catch surfaces 62 and 63.

Two posts 64 and 65 project upwardly at or slightly above the top edge of the side walls 60 and 61 to mount caps 66 and 67. The caps 66 and 67 have flat panels that fold along living hinges 68 and 69 and have openings 70 and 71 for fitting around the respective posts 64 and 65.

The living hinges 68 and 69 allow each of the caps 66 and 67 to pivot between an upright open position (as shown in FIG. 5) and a horizontal closed position (as shown in phantom in FIG. 5) to lock or unlock the base member 34 relative to the fastener assemblies 36 and 37, as will be described in detail below. The caps 66 and 67 have turned down peripheries 72 and 73 at their front and sides to overlap the arms 56 and 57. Small detents 74 and 75 at the outer side of the arms 56 and 57 can fit into corresponding recesses 76 and 77 (see FIG. 4) when the caps 66 and 67 are closed (down) to positively engage the arms 56 and 57 in a snap fit.

As best seen in FIG. 2, the mount 80 is preferably in the form of a cross in top view formed with a generally square top central area. As depicted in FIGS. 2 and 3, the mount has been rotated 180 degrees around the fastener from how the mount will be positioned in use, for easier viewing of the forward extension arm 81. There is also a rearward extension 82.

There are undercuts 83 under the forward extension arm 81 and under the square top view area. Thus, there are two arced sections 88 on the sides of the mount under the square area. The extension 81 and accompanying undercut 83 have a number of desirable advantages. First, they can optionally be designed to fit over protrusion 85 (see FIG. 3) on the rear of the hinge post, providing an interfitting meshing that provides additional resistance to upward movement when the parts are assembled.

Optionally, the wall that the protrusion extends from can instead be removed adjacent the protrusion (along with the protrusion) so as to create a downwardly open U-recess in that wall. This lets the arm 81 extend into the recess and perform an anti-rotation feature, rather than a resistor of vertical movement of the hinge assembly.

It is envisioned that the mounting assembly 32 can be sold separately or as a combined product with the seat 16 and/or cover 18. In either case, the base member 34 is attached to the seat 16 and cover 18 by assembling the hinge pins 26 and 27 into the pockets 55 of the base support 52, and the respective openings 24 in the ears 22 and 23 of the toilet seat 16 and cover 18.

This sub-assembly then can be mounted to and dismounted from the toilet base 12 as a unit. During the initial assembly, the fastener assemblies 36 and 37 are mounted to the rear extension 20 of the toilet base 12 as mentioned above.

A tightening tool, such as wrench, may be used during initial set up to tightly secure the fastener assemblies 36 and 37 to the toilet base 12. Once secured, the fastener assemblies 36 and 37 stay mounted to the toilet base 12 throughout their useful life. The base member 34 and the seat 16 and cover 18 are attached to the fastener assemblies 36 and 37 by sliding the base member 34 (and seat and cover) horizontally in the front-to-back direction with the caps 66 and 67 up.

Catch surfaces 62 and 63 of the arms 56 and 57 are spaced apart less then the lower arcs 88 of the mounts 80. As such, as the base member 34 (and seat and cover) are moved, the arms 56 and 57 will deflect outward to make space to accept the arcs of mounts 80 in the vertical openings 58 and 59 defined between arc sections of the arms.

An outermost periphery at the top of the mounts 80 will capture the arms 56 and 57 between the top surface 28 of the rear extension 20 to resist vertical movement of the base member 34. As the fit of the arms 56 and 57 around the mounts 80 is snug (e.g. like a hug), there is little or no slop from front to back or side to side.

To prevent inadvertent separation of the base member 34 (and seat and cover) from the fastener assemblies 36 and 37 (and thus the toilet base 12), the caps 66 and 67 are pivoted down to the closed position to snap onto the arms 56 and 57 and thereby resist outward deflection of the arms 56 and 57. With the caps 66 and 67 down, the fastener assemblies 36 and 37 are concealed from above the toilet. This keeps debris and urine from reaching the fastener assemblies 36 and 37, and improves the appearance of the overall assembly. The described assembly of the parts on the toilet is made easily, yet is robust and unlikely to be inadvertently disconnected.

When desired, such as when cleaning, the seat 16 and cover 18 (and base member 34) can be readily removed from the toilet base 12. The caps 66 and 67 are lifted up (extended edges 86 (see FIG. 3) can facilitate gripping the cap for this purpose. Once the caps have been lifted up, the seat 16 and cover 18 (and base member 34) are pulled or slid straight (horizontally) away from the fastener assemblies 36 and 37. With the caps 66 and 67 up, the arms 56 and 57 are free to deflect outward and thereby disengage the catch surfaces 62 and 63 from the mounts 80.

As mentioned, with the seat 16 and cover 18 also goes the base member 34, and thus, the only components left attached to the toilet base 12 are the fastener assemblies 36 and 37. These assemblies 36 and 37 have a small top view footprint, which leaves nearly all of the top surface 28 of the rear extension 20 of the toilet base 12 exposed, thereby facilitating thorough cleaning.

Referring now to FIG. 6, in an alternative embodiment, rather than a single unitary base member with two receivers, there can be two separate, smaller base members 34A and 35A each having its own pair of extension arms 56A and 57A, caps 66A and 67A, and pocket (not shown) for the hinge pins. A center piece 90A would then fit between the two base members 34A and 35A. Like before, the arms 56A and 57A removably mate with fastener assemblies 36A and 37A permanently secured to the toilet base.

While preferred embodiments of the present invention have been shown, a variety of additional changes can be made to them without departing from the spirit or scope of the invention. For example, while two deflectable extension arms are described for engaging each fastener, a single arm could be used and/or only a single arm may be deflectable while the other is rigid.

Further, although a toilet covering member including both a cover and a seat has been described, it will be apparent that various types or combinations of covering members can be used. For example, it is not necessary there be both a cover and seat. Either can be attached alone if desired (e.g., for a public restroom just a seat is more typical).

Accordingly, the claims should be looked at in order to judge the full scope of the invention.

INDUSTRIAL APPLICABILITY

The present invention provides an improved mounting assembly suitable to attach a toilet seat and/or cover to a toilet base.

What is claimed is:

1. An assembly for mounting a cover to a toilet base, the assembly comprising:

a fastener removably extendable through a rear extension of the toilet base;

a base member adapted to support the cover in pivotal fashion, the base member having an essentially horizontally extending deflectable extension arm extending substantially parallel to a top surface of the rear extension of the toilet base in use and defining in part an opening for receiving the fastener; and a mount disposed about the fastener and having a portion extendable on top of the extension arm;

wherein the base member is connected to and disconnected from the fastener by pivotal deflection of the extension arm in an essentially horizontal plane substantially parallel to the top surface of the rear extension of the toilet base so that the base member is removably attached to the toilet base.

2. The assembly of claim 1, wherein the mount is cross-shaped in top view.

3. The assembly of claim 2, wherein the mount has a forward cross arm which restricts relative rotation of the mount relative to the base member.

4. The assembly of claim 2, wherein the mount has an undercut portion.

5. The assembly of claim 1, wherein the base member has two such extension arms arranged so as to be spaced apart on opposed sides of the opening, whereby arcuate portions of the arms can hug arcuate portions of the mount.

6. The assembly of claim 1, further including a cap capable of restricting outward deflection of the extension arm when the cap is in a closed position.

7. The assembly of claim 6, wherein the cover is hinged to the base member.

8. The assembly of claim 7, wherein the cover is linked to the base member via a living hinge.

9. The assembly of claim 1, wherein the fastener comprises a bolt extendable through the opening in the base member and a hole in the rear extension of the toilet base, and wherein the assembly further comprises a nut positionable on the bolt underneath the rear extension of the toilet base.

10. The assembly of claim 1, wherein the cover is selected from the group consisting of toilet seats, toilet covers, and combined toilet seats and covers.

* * * * *